US005474486A

United States Patent [19]

Chilton et al.

[11] Patent Number: 5,474,486

[45] Date of Patent: Dec. 12, 1995

[54] REMOTELY CONTROLLED, TRANSFORMABLE, WATER SQUIRTING TOY VEHICLES

[75] Inventors: Seth M. Chilton, Haddonfield; Michael G. Hetman, Medford Lakes; Jonathan A. Jaffe, Voorhees, all of N.J.

[73] Assignee: Tyco Industries, Inc., Mount Laurel, N.J.

[21] Appl. No.: 161,636

[22] Filed: Dec. 2, 1993

[51] Int. Cl.[6] ..... A63H 30/04

[52] U.S. Cl. ..... 446/456; 446/368; 446/470; 446/475; 446/487; 222/78

[58] Field of Search ..... 446/74, 269, 368, 446/470, 475, 487, 267, 432, 435, 454, 456; 222/78; 239/211

[56] References Cited

U.S. PATENT DOCUMENTS

| | | | |
|---|---|---|---|
| 819,653 | 5/1906 | Hawke . | |
| 1,266,106 | 5/1918 | Coup . | |
| 1,422,862 | 7/1922 | Hofmann | 446/475 |
| 1,640,417 | 8/1927 | Marks | 446/432 |
| 2,447,946 | 8/1948 | La Forge . | |
| 2,846,813 | 8/1958 | Giardina | 446/432 |
| 3,374,708 | 3/1968 | Wall et al. . | |
| 3,479,101 | 11/1969 | Poor et al. . | |
| 3,521,527 | 7/1970 | Gies et al. | 91/1 |
| 3,613,298 | 10/1971 | Okonski . | |
| 3,731,428 | 5/1973 | Glass et al. | 446/432 |
| 3,789,541 | 2/1974 | Good et al. | 446/432 |
| 3,869,825 | 3/1975 | Heberlein . | |
| 3,906,888 | 9/1975 | Justinien | 115/19 |
| 3,993,250 | 11/1976 | Shure | 239/332 |
| 4,022,350 | 5/1977 | Amron | 222/79 |
| 4,114,309 | 9/1978 | Gay | 446/475 |
| 4,154,375 | 5/1979 | Bippus | 222/325 |
| 4,193,517 | 3/1980 | Fetty et al. . | |
| 4,226,292 | 10/1980 | Monte et al. | 180/6.5 |
| 4,270,307 | 6/1981 | Arigaya | 46/254 |
| 4,476,948 | 10/1984 | Komoto et al. | 180/7.2 |
| 4,488,603 | 12/1984 | Schmittmann et al. . | |
| 4,556,392 | 12/1985 | Chang . | |
| 4,565,321 | 1/1986 | Vestergaard . | |
| 4,630,756 | 12/1986 | Amici et al. . | |
| 4,703,892 | 11/1987 | Nadel | 446/368 |
| 4,706,848 | 11/1987 | D'Andrade . | |
| 4,743,030 | 5/1988 | Auer et al. . | |
| 4,750,641 | 6/1988 | Chin-Fu . | |
| 4,768,681 | 9/1988 | Dean et al. . | |
| 4,826,465 | 5/1989 | Fleischmann | 446/162 |

(List continued on next page.)

FOREIGN PATENT DOCUMENTS

| | | | |
|---|---|---|---|
| 851754 | 10/1952 | Germany | 446/432 |
| 2220582 | 1/1990 | United Kingdom . | |

OTHER PUBLICATIONS

Nikko America, Inc., 1993 Domestic Price List (Cover Sheet and one page identifying "Volunteer Fire Truck" Item #16066 plus one catalog sheet entitled Volunteer Fire Truck/16066) (three pages total).

*Primary Examiner*—Robert A. Hafer
*Assistant Examiner*—Jeffrey D. Carlson
*Attorney, Agent, or Firm*—Panitch Schwarze Jacobs & Nadel

[57] ABSTRACT

A remotely controllable, transforming, water squirting toy vehicle includes a structure in the form of a lever arm mounted for pivotal movement with respect to a remainder of the vehicle from a first position in which a surface of the arm is hidden within the vehicle to a second, elevated position in which the hidden surface of the arm is exposed. The hidden surface of the arm bears the likeness of a snake or other creature and includes a nozzle fluidly coupled to a pump and reservoir within the remainder of the vehicle. A control system in the vehicle receives and processes steering and propulsion control signals as well as an arm raising/water pumping control signal. A single actuator controls the movement of the lever arm which is spring loaded, by releasing the lever arm from a latched position and powers the pump driving liquid from the reservoir to the nozzle.

19 Claims, 8 Drawing Sheets

U.S. PATENT DOCUMENTS 4,897,070 1/1990 Wagstaff .
5,055,082 10/1991 Varner .
5,071,387 12/1991 Pottick .
5,135,427 8/1992 Suto et al. ..... 446/433
5,150,841 9/1992 Silvenis et al. .
5,215,491 6/1993 Willet et al. ..... 446/176
5,295,890 3/1994 Myers .

REMOTELY CONTROLLED, TRANSFORMABLE, WATER SQUIRTING TOY VEHICLES

FIELD OF THE INVENTION

The present invention relates to vehicle toys and, in particular, to toy vehicles having unusual action capabilities.

BACKGROUND OF THE INVENTION

Vehicle toys are well known. Remotely controlled and radio-remotely controlled vehicle toys, in particular, have come to constitute a significant specialty toy market.

Manufacturers of such toys attempt to duplicate well known vehicles as well as the latest in automotive developments, including specialty entertainment vehicles. In addition, manufacturers constantly seek new ways and features to add innovative action to such toys to make such vehicles more versatile and/or entertaining.

SUMMARY OF THE INVENTION

In one aspect, the invention is a transforming, water squirting toy vehicle comprising: a ground contacting vehicle propulsion member; a propulsion unit drivingly coupled with the vehicle propulsion member; a structure mounted to a remainder of the vehicle for movement from a first position to a second position, a surface of the structure being hidden within the vehicle in the first position and exposed to view in the second position, the surface having an appearance of at least part of a creature; a nozzle located on the structure at least proximal to the hidden surface, so as to be hidden within the vehicle in the first position of the structure and exposed to view in the second position of the structure; and a pump fluidly coupled with the nozzle.

In another aspect, the invention is a remotely controlled, water squirting toy vehicle responsive to propulsion and water squirting control signals from a remote control unit separate from the vehicle, the vehicle comprising: a ground contacting vehicle propulsion member; an electrically actuated propulsion unit drivingly coupled with the propulsion member; a liquid reservoir; a nozzle mounted to the vehicle so as to project a liquid stream from the vehicle in at least one configuration of the vehicle; an electrically actuated pump fluidly coupling the reservoir with the nozzle; a first drive circuit responsive to a propulsion control signal received by the vehicle from the remote control unit to selectively supply electric power to the propulsion unit; and a second drive circuit responsive to a water squirt control signal received by the vehicle from the remote control unit to selectively supply power to the electrically actuated pump, the second drive circuit supplying power independently from power supplied by the first drive circuit.

In yet another aspect, the invention is a transforming, water squirting toy vehicle comprising a ground contacting vehicle propulsion member, a drive unit drivingly coupled with the vehicle propulsion member, a structure mounted to a remainder of the vehicle for movement from a first position to a second position, a surface of the structure being hidden within the vehicle in the first position and exposed to view in the second position, the surface having an appearance of at least part of a creature; a nozzle located on the vehicle so as to be exposed to view at least in the second position of the structure; and a pump fluidly coupled with the nozzle.

BRIEF DESCRIPTION OF THE DRAWINGS

The foregoing summary as well as the following detailed description of preferred embodiments of the invention will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings, which are diagrammatic.

DETAILED DESCRIPTION OF PREFERRED EMBODIMENTS

Figure 14:
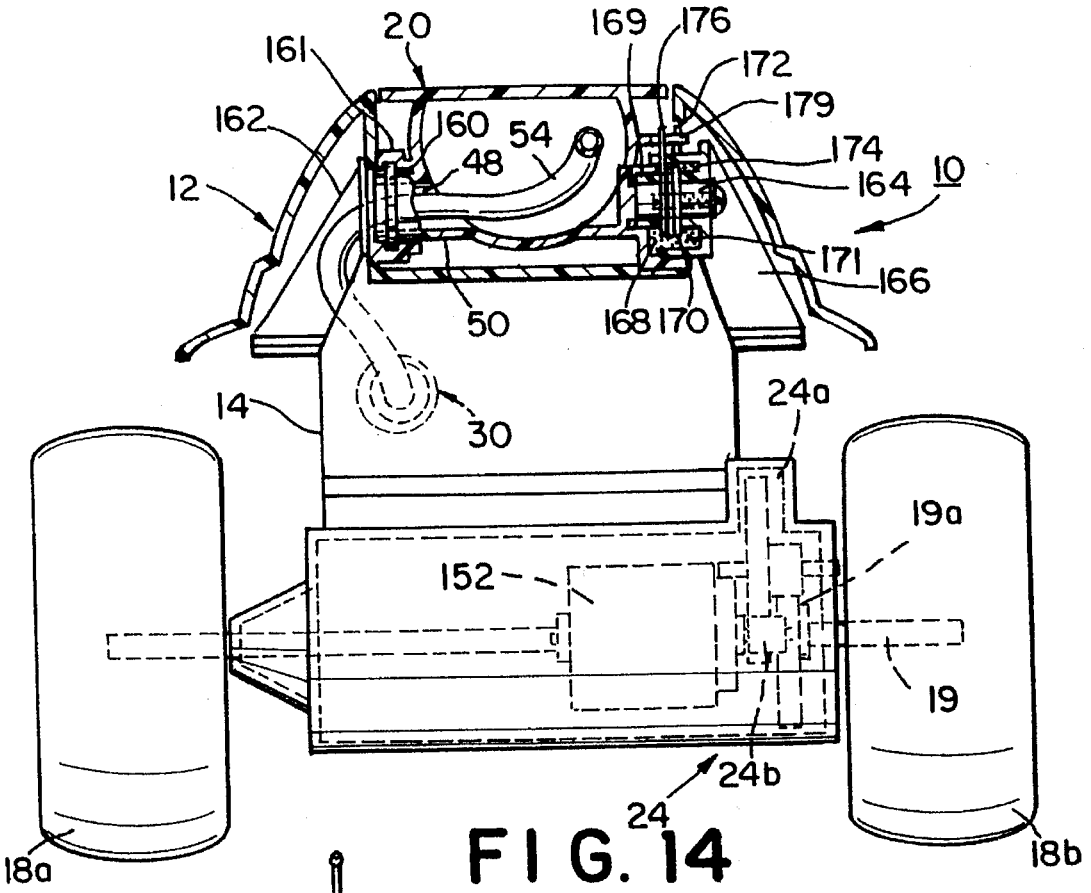
FIG. 14 is a partially broken away rear elevational view of the vehicle in the configuration of FIG. 1.

In the drawings, like numerals are used to indicate like elements throughout. A preferred water squirting remotely controlled toy vehicle of the present invention is indicated generally at 10 in FIGS. 1 through 4. The term, "remotely controlled" is used broadly to include both hard wire and wireless controlled toy vehicles. Vehicle 10 is responsive to control signals sent to the vehicle from a remote control unit 120 which is remote to and spaced from the vehicle. Preferably, the vehicle 10 includes a chassis indicated generally at 14 and an outer body shell indicated generally at 12 attached to the chassis 14. The vehicle 10 is conventional in that it has a pair of steerably mounted, road contacting, vehicle supporting front wheels **16*a*, 16*b* and a pair of driven, road contacting, vehicle supporting and propelling rear wheels 18*a*, 18*b*. The steering, which is conventional, uses a link arm 23, which pivotably couples the pair of front wheels 16*a*, 16*b* together. The link arm 23 is selectively driven laterally in the vehicle by an electrically operated actuator, which is indicated diagrammatically at 22 and which is also conventional and mounted near the front end 14*a* of the vehicle. Referring to FIG. 14, a vehicle propulsion unit 24 is indicated in phantom and preferably includes at least one electric motor 152 drivingly coupled with at least one and preferably both of the pair of rear wheels 18*a*, 18*b*, to propel the vehicle 10. Preferably, a reduction gear train indicated generally at 24*a* couples a pinion drive member 24*b* of the motor 152 with a reduction gear 19*a* fixed to a rear axle 19. The pair of wheels 18*a*, 18*b* are preferably fixedly mounted to the opposing ends of the rear axle 19**.

Figure 1:
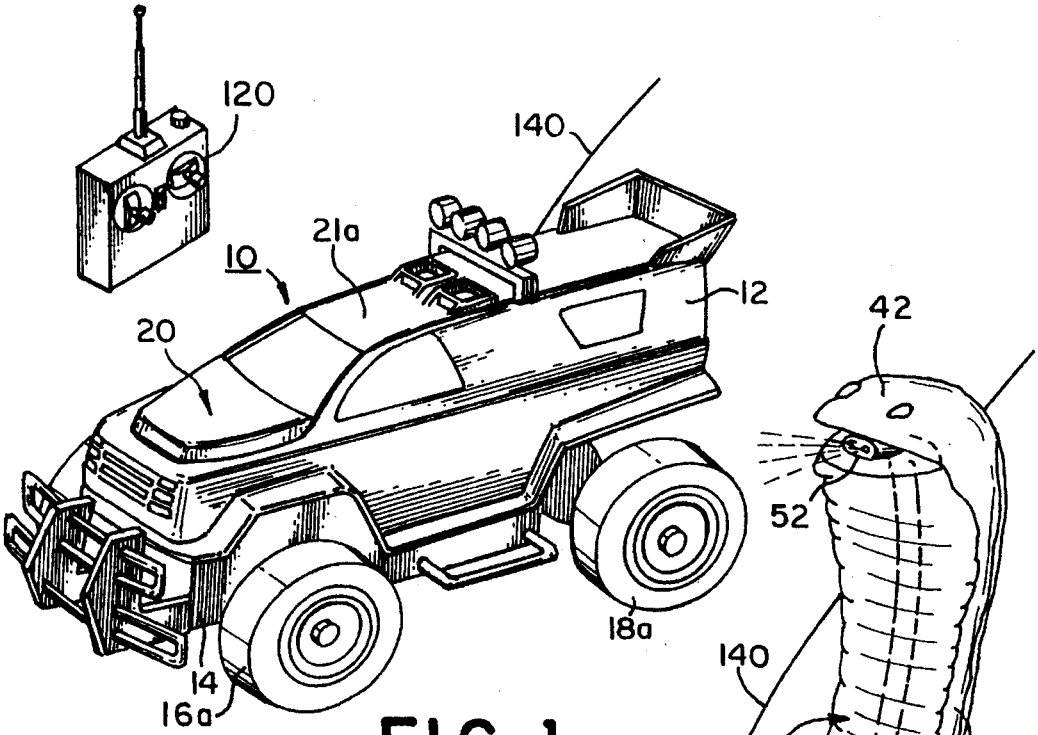
FIG. 1 is a perspective view of a preferred embodiment vehicle of the invention in a first configuration.
Figure 2:
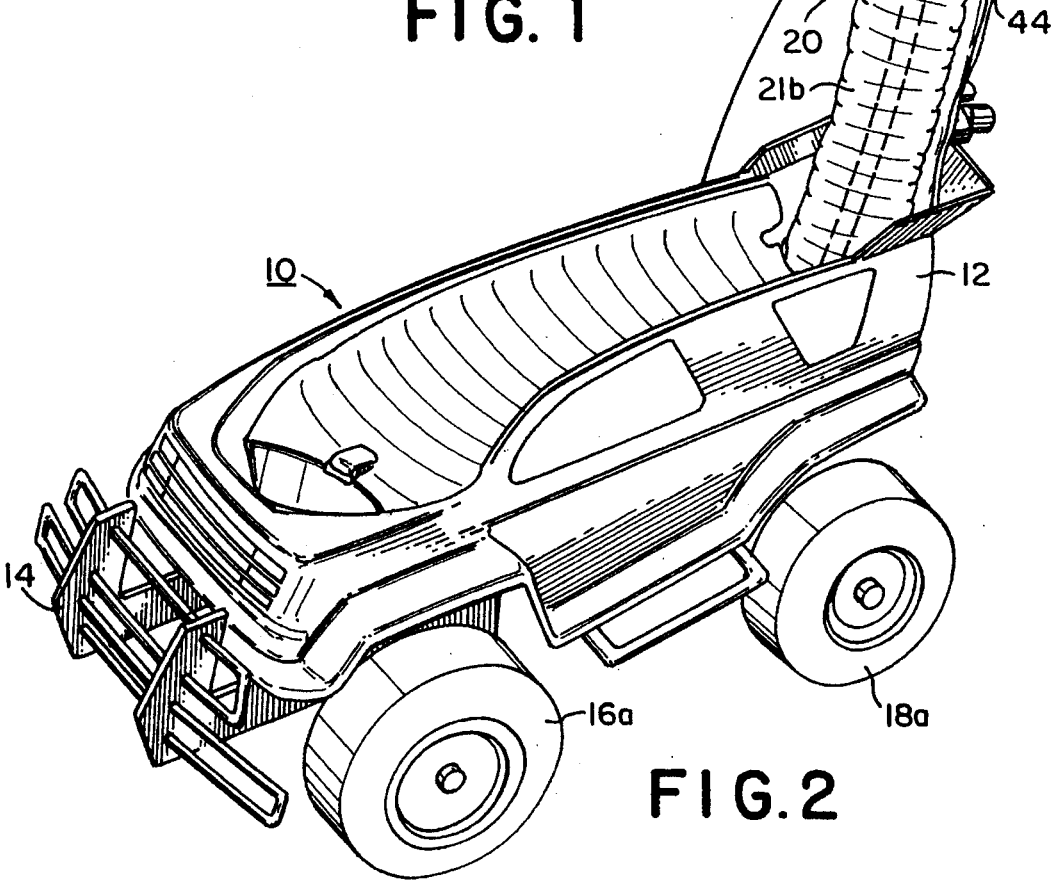
FIG. 2 is a perspective view of the vehicle of FIG. 1 in a second, water squirting configuration.
Figure 3:
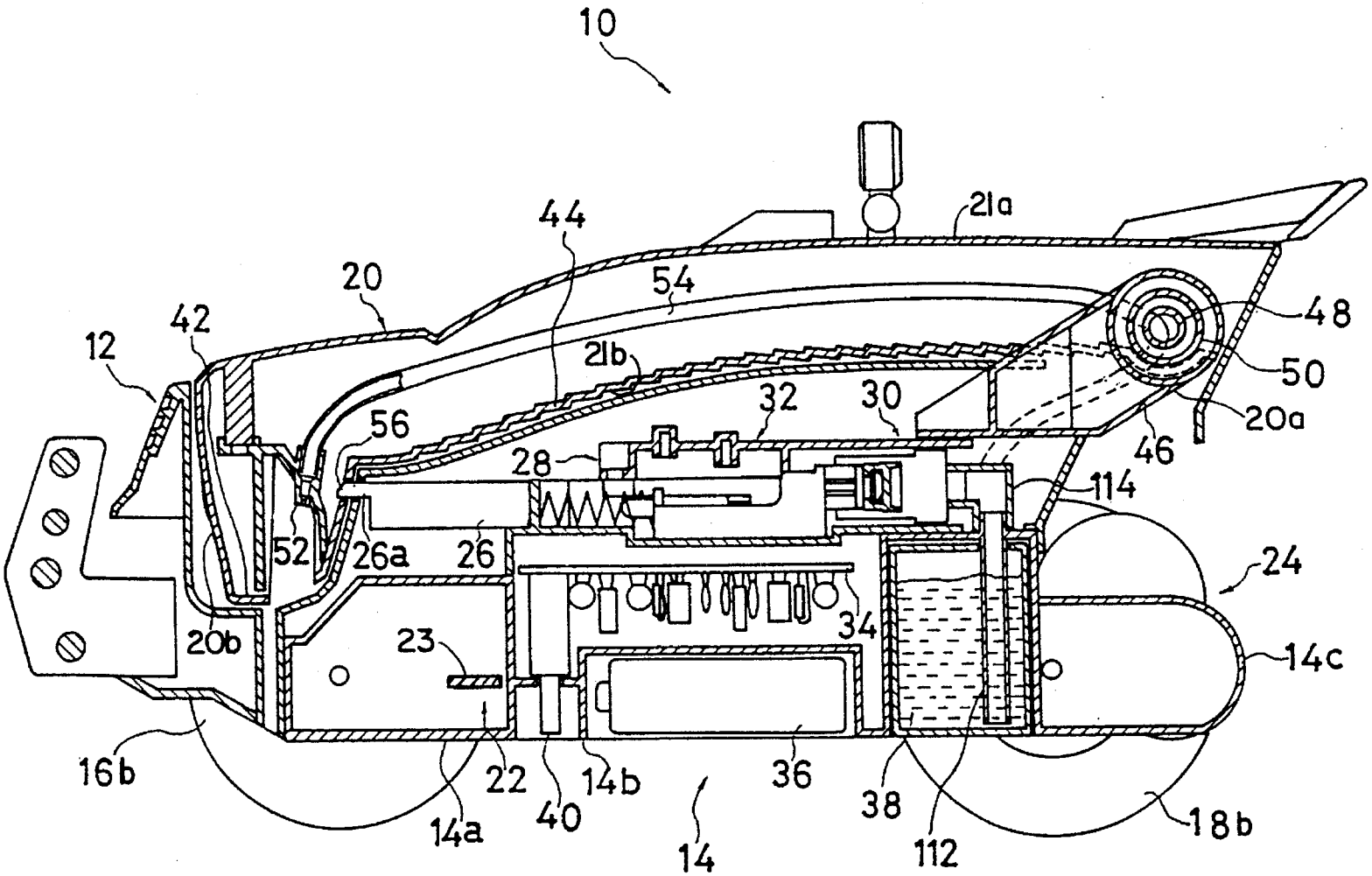
FIG. 3 is a preferably broken away side elevation of the vehicle in the configuration of FIG. 1.

Comparing FIGS. 1 and 2, an important aspect of the present invention is the provision of a structure 20 mounted to the remainder of the vehicle 10 for movement between a first position and a second position. Referring to FIG. 3, the structure 20 preferably is in the form of a lever arm also indicated at 20, having one end 20*a*, which is pivotably mounted to the remainder of the vehicle proximal a rear end 14*c* of the vehicle, and an opposing free end 20*b*. The free end 20*b* extends to proximal the front end 14*a* of the vehicle 10 when the lever arm 20 is located in the first position, shown in FIGS. 1, 3 and 4 and is elevated generally above the remainder of the vehicle 10 when in the second position shown in FIG. 2.

As can be seen among FIGS. 1 through 3, the lever arm 20 has an "outer" surface 21*a*, which appears to be an integral part of the highly stylized though conventional vehicle body shell 12. Lever arm 20 further preferably includes an inner surface, which is indicated generally at 21*b*. Inner surface 21*b* is hidden within the vehicle 10 when the lever arm 20 is in the first position shown in FIGS. 1, 3 and 4 and is exposed to view when the lever arm 20 is moved to its second, preferably elevated position shown in FIG. 2. Preferably, the inner surface 21*b* has the appearance of at least part of a creature. In particular, inner surface 21*b* preferably includes the head or face 42 and at least part of the body 44 of a snake.

The lever arm 20 is maintained in the first position concealing inner surface 21*b* by means of a latch member 26, which is the operative part of a preferred spring-biased, electrically actuated latch assembly indicated generally at 28. Preferably, the latch assembly 28 cooperates with an electrically actuated pump, indicated generally at 30, by sharing an electrically powered actuator indicated generally at 32. The operation of the electrically powered actuator 32 as well as that of the steering actuator 22 and propulsion unit 24 are preferably selectively controlled by a control circuit indicated generally at 34, which is powered by a battery power supply 36. An off/off switch 40 selectively couples the battery power supply 36 with the circuit 34.

According to yet another important aspect of the present invention, the remotely controlled toy vehicle 10 has a remotely controlled, water squirting capability. The vehicle 10 preferably includes a liquid reservoir 38, preferably removably mounted to the underside of the chassis 14. A nozzle 52, preferably a stream emitting type nozzle, is preferably located on the lever arm 20, proximal the free end 20*b* of the arm. Nozzle 52 is further located desirably proximal the hidden surface 21*b* of the lever arm 20 so as to be normally concealed from view when the lever arm is in its first position concealing surface 21*b* and thereafter exposed to view with the hidden inner surface 21*b* when the arm 20 has moved to its second position indicated in FIG. 2. Preferably nozzle 52 is located in the head or face 42 of the snake. Preferably, a flexible tube 54 extends from the nozzle 52 the length of the arm 20 and through a central opening 48 of a transverse, hollow, bearing member 50 of the arm 20 and into the remainder of the vehicle 10 where it is fluidly coupled with the outlet of the pump 30.

Figure 4:
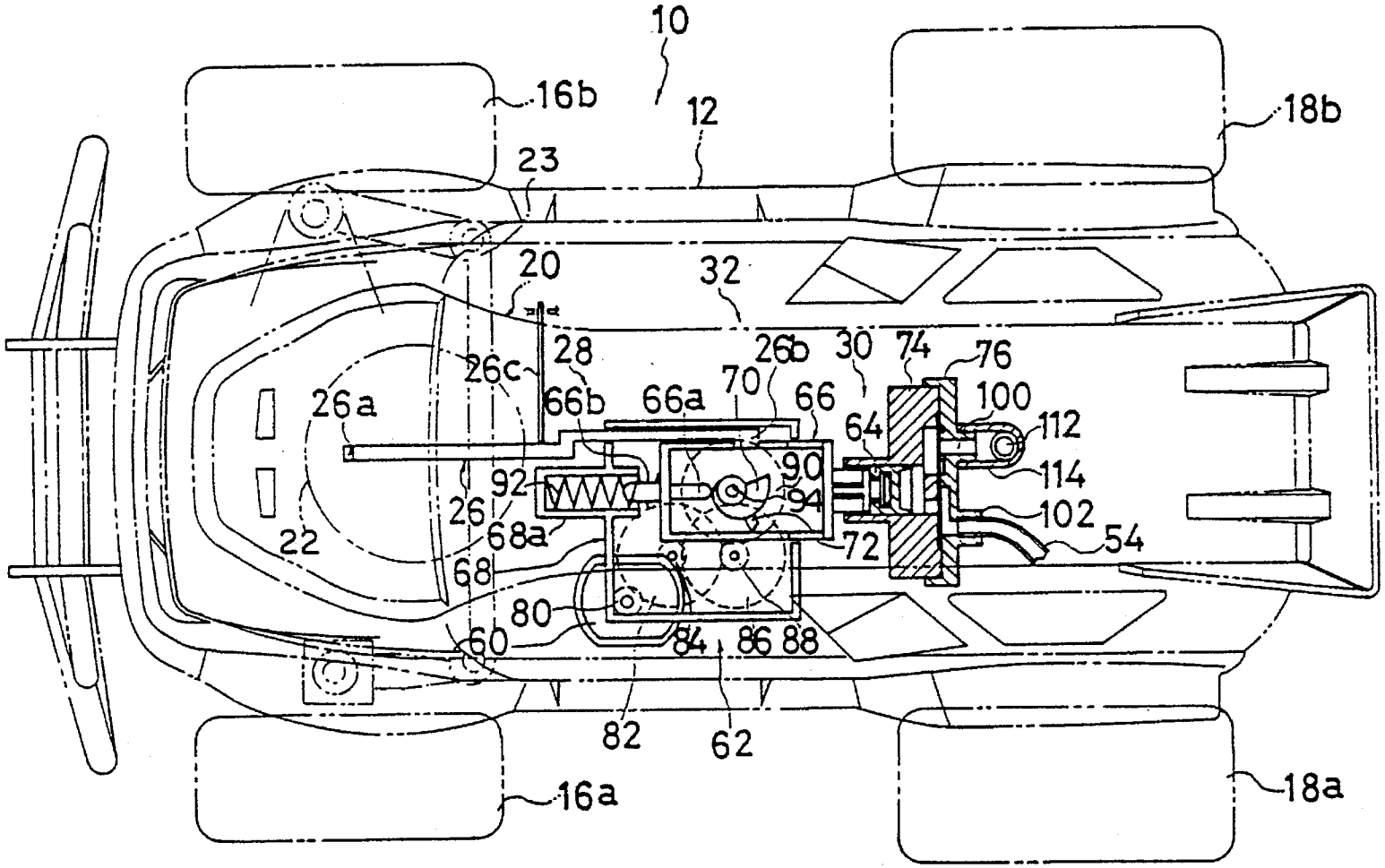
FIG. 4 is a partially broken away top plan view of the vehicle in the configuration of FIG. 1.

Referring to FIG. 4, the electrically powered actuator 32 is preferably provided in the form of an electric motor 60 coupled with a reduction transmission indicated generally at 62, which converts a high speed rotary output of the motor 60 into a slower rotation of a cam shaft 94. A housing 68 of the transmission 62 is preferably part of or coupled with chassis 14 and physically supports for linearly reciprocating movement, the latch member 26 and a fluid drive member in the form of a pump piston arm 66 with piston 64. The drive pinion 80 of motor 60 preferably rotates a first reduction gear 82 having a pinion 84 driving a second reduction gear 86 having a pinion 88 driving a third reduction gear 90 rotating a cam shaft 94. The shaft 94 preferably supports a first pump cam 70 and a second latch cam 72. Preferably pump 30 is further provided by a cylinder 74 (FIGS. 9 and 10) defining a chamber 74*a*. Chamber 74*a* receives an end of piston arm 66 carrying a piston 64, which is mounted for sliding, reciprocating movement within the chamber 74*a* of cylinder 74. Preferably, a flexible rubber or plastic cup defines the piston 64. The piston arm 66 further supports at an end opposite piston 64, a locating pin 66*b* (see FIG. 4) and an opposing, cam following pin 66*a*. A cavity or chamber 68*a* is provided in housing 68 to receive locating pin 66*b* and retains a pump biasing member in the form of a coil spring 92 around the pin 66*b*.

Figure 5:
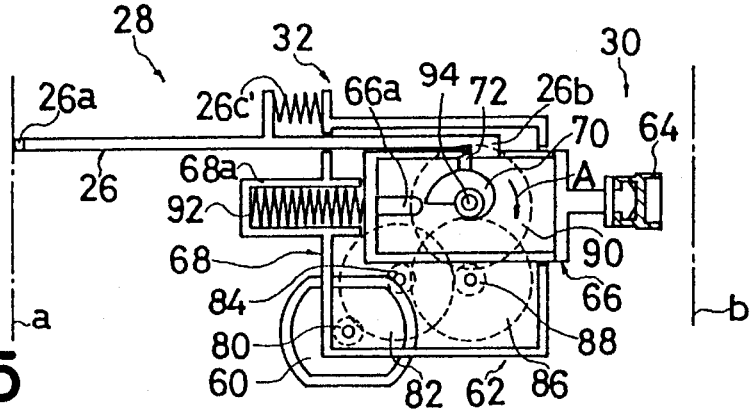
FIGS. 5–8 depict in steps operation of the cam drives of the latch release and the pump.
Figure 6:
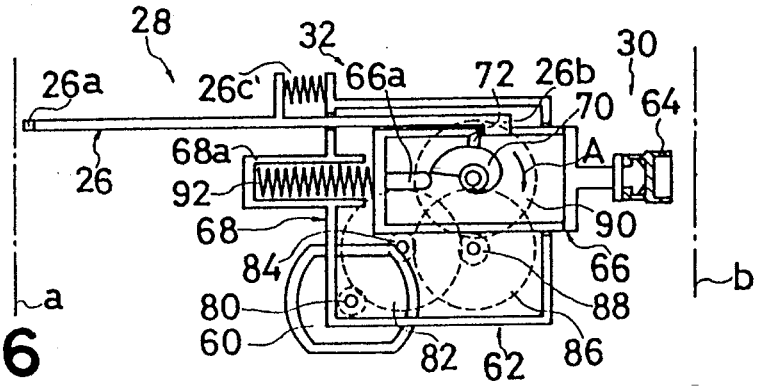
Figure 7:
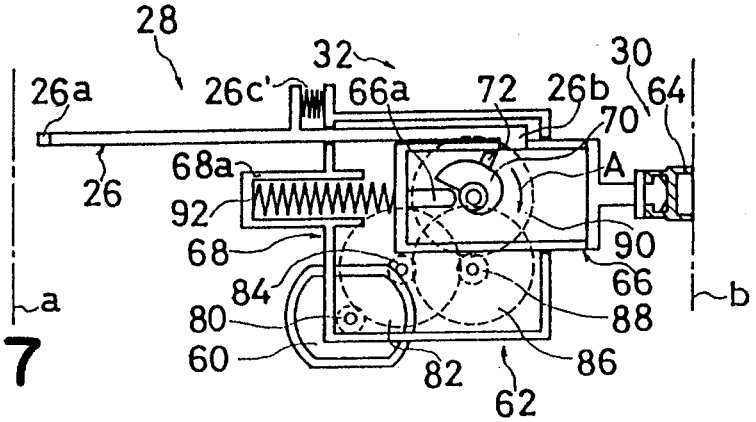
Figure 8:
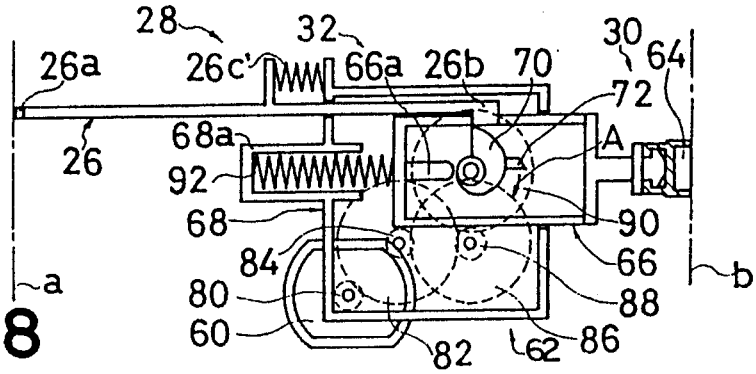

Operation of the electrically powered actuator 32 is shown in steps in FIGS. 5–8, particularly with respect to stationary reference lines a and b. The remote end of cam following pin 66*a* follows the first cam 70 as it is rotated clockwise in the direction of arrow A by cam shaft 94 during operation of the electric motor 60 of the actuator 32. In FIG. 5, the peak of the lobe defining the pump cam 70 contacts cam following pin 66*a* while the lever actuating cam 72 engages a step 26*b* projecting from a lateral side of latch member 26. The engagement end 26*a* of latch member 26 is in a first position extending to reference line a with bias spring 26*c* fully extended, indicating that it is engaged with the arm 20, while piston 64 is in its most retracted position spaced away from reference line b with bias spring 92 fully compressed. Referring now to FIG. 6, which depicts only a slight rotation of the cam 70 and 72 on shaft 94 from the position in FIG. 5, cam following pin 66*a* has begun to drop from the lobe of pump cam 70. Bias spring 92 urges arm 66 to the right in the figure, permitting the piston 64 to also extend slightly to the right in the figure towards reference line b. Latch cam 72 has moved latch member 26 slightly to the right, thereby beginning to withdraw the engagement end 26*a* of the latch member 26 from the opening 56 (as seen in FIG. 3), as indicated by retraction of the end 26*a* of latch member 26 from reference line a. In FIG. 7, cam following pin 66*a* has dropped fully from the lobe of pump cam 70, thereby permitting bias member spring 92 to urge piston arm 66 and piston 64 fully to the right in the figure against reference line b. At the same time, latch cam 72 continues to move the latch member 26 further to the right to a second position fully disengaging latch member tip 26*a* from lever arm 20 and fully compressing a biasing member spring 26*c*. In FIG. 8, cam shaft 72 has rotated approximately 90° from its original position in FIG. 5. Piston 64 and arm 66 remain in the fully extended position under bias member spring 92 abutting reference line b while latch cam 72 has rotated past and disengaged from projecting step 26*b*, thereby permitting biasing member 26*c* to bias latch member 26 back to its original position with engaging end 26*a* fully extended abutting reference line a.

Figure 9:
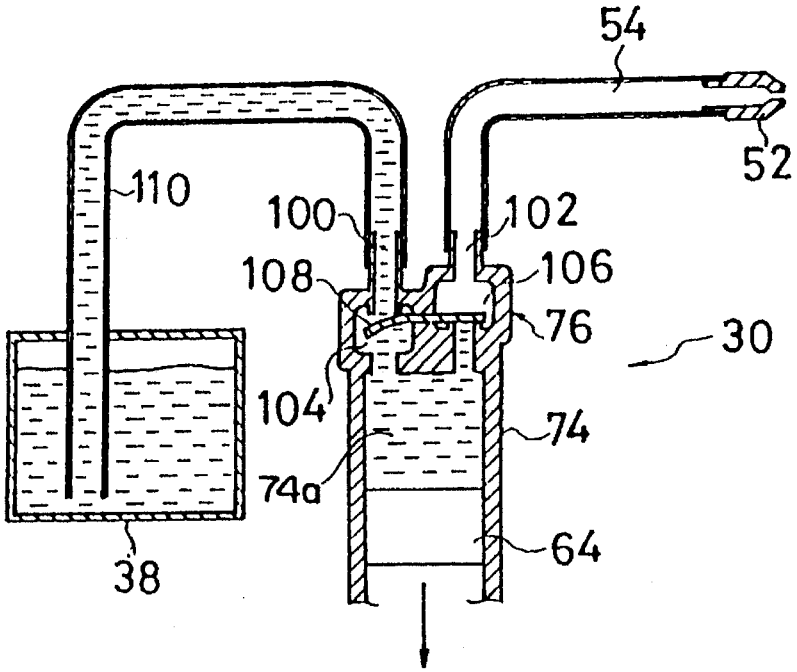
FIGS. 9–10 depict in steps the operation of the pump.
Figure 10:
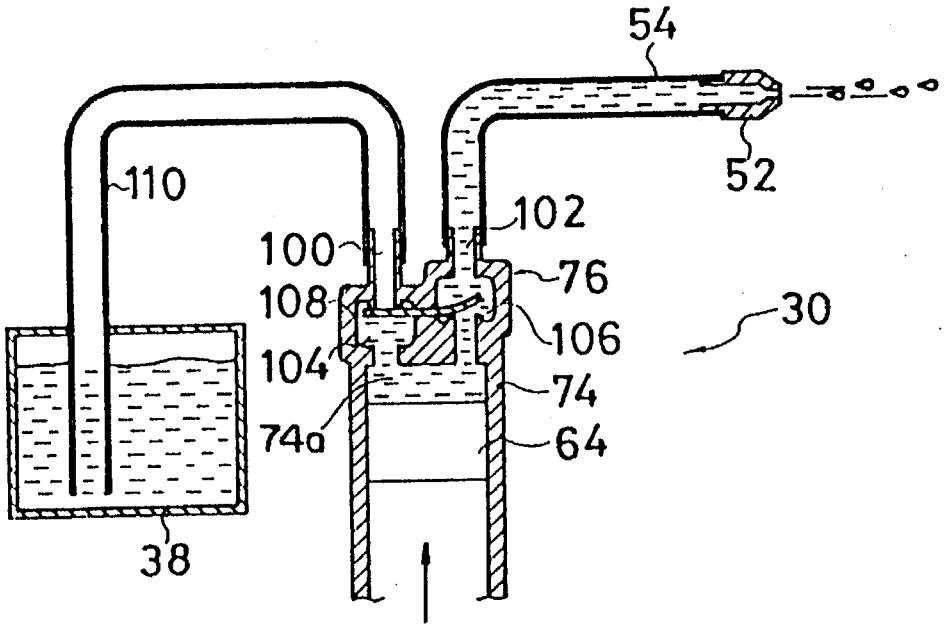

Referring to FIGS. 3, 9 and 10, the remainder of pump 30 includes pump inlet and outlet 100 and 102 respectively, which extend from a chambered end 76. Inlet and outlet chambers 104 and 106 are provided in the chambered end 76 on opposing sides of a valve flap member 108, which simultaneously defines a one-way inlet valve from inlet 100 and a one-way outlet valve to outlet 102. The pump 30 is fluidly coupled with reservoir 38 through the inlet 100 and a length of tubing 110 while it is fluidly coupled with nozzle 52 through flexible tubing 54, the remote end of which is coupled with the outlet 102. Thus, the reservoir 38 is fluidly coupled to nozzle 52 through pump 30. As is shown in FIGS. 9 and 10, when piston 64 is retracted from the chambered end 76 of cylinder 74, a vacuum is formed in chamber 74*a* by the one-way valves and draws water from reservoir 38 through tubing 110 and inlet 100. When the piston 64 is advanced towards the chambered end 76, water is forced from piston chamber 74*a* through the opposing side of valve flap member 108 and outlet 102 into tubing 54 from which it is expelled through nozzle 52.

Figure 11:
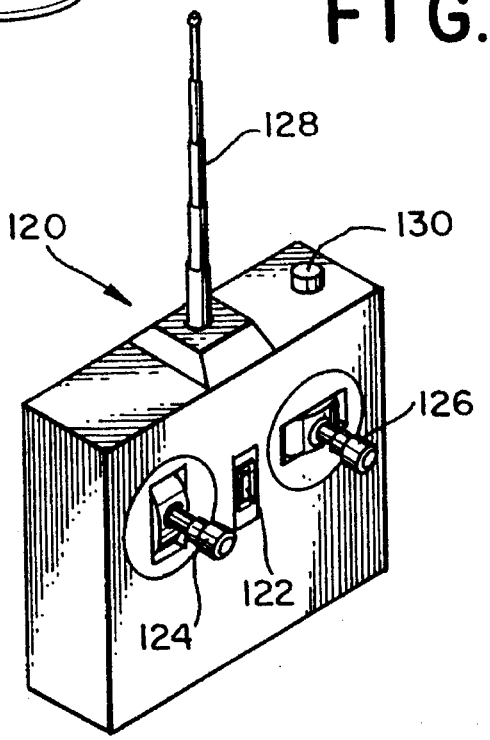
FIG. 11 depicts an exemplary, hand-held remote control unit.

FIG. 11 depicts diagrammatically a hand-held remote control unit, indicated generally at 120 for controlling the operation of vehicle 10. The unit 10 preferably includes an on/off power switch 122, a first toggle control lever 124 controlling forward and reverse motion of the vehicle 10, a second toggle control lever 126 controlling left and right steering movement of the vehicle 10, an antenna 128 and a latch release/pump actuation control button 130.

Figure 12:
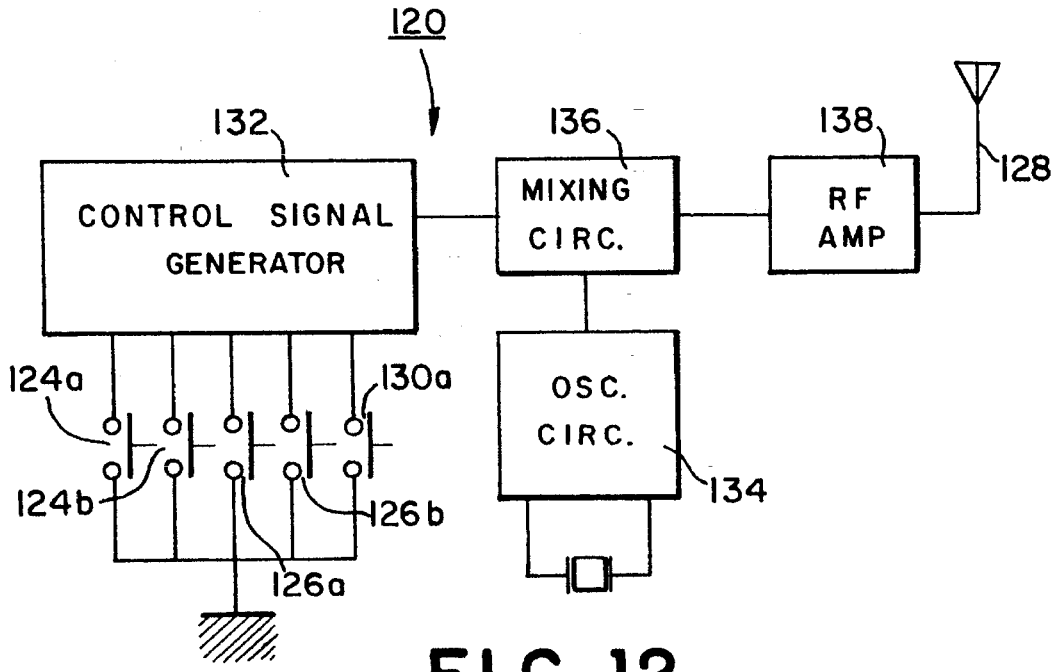
FIG. 12 is a block diagram of the remote control unit.

FIG. 12 depicts diagrammatically the major circuit components of the hand-held remote control unit 120. Unit 120 preferably includes pairs of contacts 124*a* and 124*b*, which are closed by movement of the first toggle lever 124 in the forward and reverse directions, respectively; pairs of contacts 126*a* and 126*b*, which are closed by left and right movement of the second toggle lever 126, respectively; and a pair of contacts 130*a*, which are closed by depression of the button 130. Each pair of contacts 124*a*, 124*b*, 126*a*, 126*b* and 130*a* is coupled to a separate channel input of a control signal generator, indicated generally at 132, which provides an output control signal or signal component for each contact pair to a mixing circuit 136, controlled by an oscillator circuit 134. Mixing circuit 136 preferably outputs a control signal to a radio frequency amplifier 138, which transmits the remote control signal through antenna 128 to the vehicle 10.

Figure 13:
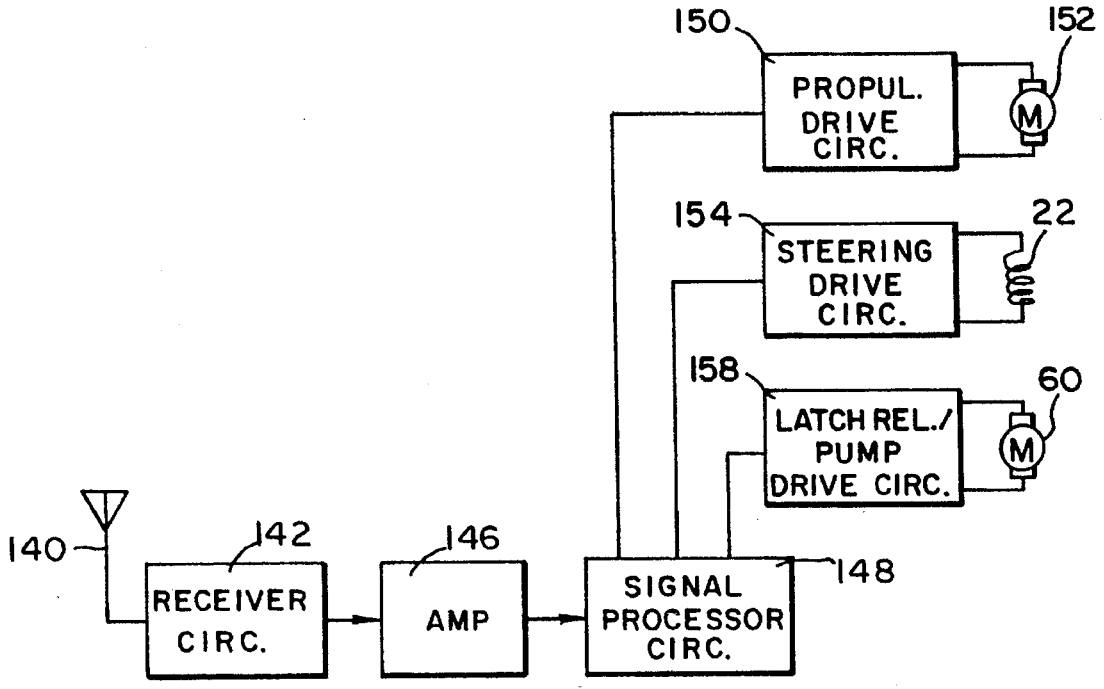
FIG. 13 is block diagram of the control circuitry of the vehicle.

Referring to FIG. 13, the vehicle 10 preferably includes an antenna 140 for receiving wireless control signals. More specifically, antenna 140 detects the radio control signal transmitted by remote control unit 120 from locations remote to the vehicle 10 and passes the radio control signal into the control circuit 34. Components of circuit 34 in turn selectively couple the battery power supply with the propulsion unit motor 152, steering actuator 22 and the prime mover 60 of electrically powered actuator 32 in response to remote control signals from unit 120. The major elements of the exemplary control circuit 34 are a receiver circuit 142, an amplifier circuit 146 and a signal processor circuit 148. Signal processor circuit might be an analog, binary and/or digital circuit which divides, demixes, demultiplexes and/or decodes the received radio control signal, depending upon the particular control scheme selected, to identify the original component signals generated by the contacts 124*a*, 124*b*, 126*a*, 126*b* and 130*a* and control signal generator 132 and to selectively drive steering actuator 22, propulsion motor 152 or prime mover 60, in a selected direction, where appropriate.

Any of a wide variety of control circuits and signal processors are known and available and can be selected for use in this application. Signal processor circuit 148 is preferably provided with at least three separate output channels, each of which is used to control a separate drive circuit: a propulsion electric drive circuit 150 coupled with drive motor 152; a steering electric drive circuit 154 coupled with steering actuator 22; and a latch release/pump electric drive circuit 158 coupled with the electric motor 60 of the electrically powered actuator mechanism 58. Each electric drive circuit 150, 154, and 158 effectively selectively couples the vehicle battery power supply 36 with the appropriate motor 152 or 60 or actuator 22 in response to the remote control signals received from the remote control unit 120 to effectively selectively couple the electric motor or actuator coupled with one drive circuit with the battery power supply or other power supplied to the vehicle. Each drive circuit operates independently from the operation of each other electric drive circuit.

Preferably, separate channels and/or frequency bands can be used to provide composite or multifunction control signals from the remote control unit 120 to the control circuit 34. A multi-channel or multi-band controller having a first control member for forward and reverse motor operation, a second control for left to right steering control and a third control member for another operation is disclosed, for example, in U.S. Pat. No. 5,322,469, assigned to the assignee of this application and incorporated by reference herein in its entirety. Alternatively, a pair of independently operated and controlled motors can be provided to drive separate wheels or other propulsion members on either side of the vehicle in the manner disclosed, for example, in U.S. Pat. No. 5,135,427 and in U.S. Pat. No. 5,429,543 filed Jul. 31, 1992, both of which are assigned to the assignee of this application and incorporated by reference herein in their entirety. Such control systems are conventional and can be obtained directly from manufacturers such as Taiyo Kogyo of Tokyo, Japan and others or U.S. distributors selling radio control vehicle products and/or parts.

Figure 15:
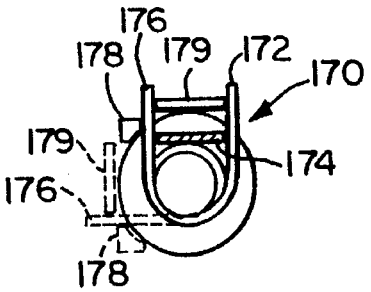
FIG. 15 is a side elevational view of a torsional spring biasing member used to elevate the arm of the vehicle.

FIGS. 14 and 15 depict in partially broken away rear and side views respectively, portions of a preferred pivot mechanism for lever arm 20. Arm 20 includes the transverse, hollow bearing member 50, which is preferably provided with a circular flange 160 at one end. Flange 160 is preferably captured in a bearing block, indicated generally at 161, which is part of or fixedly coupled with a bearing support member 162 of the chassis 14. The opposing end of bearing member 50 preferably includes a bearing pin 164, which is received in a central bore of a pivot support member 166, which is also fixedly coupled with or forms part of the chassis 14. Preferably, the central bore and an annular groove 168 around the central bore are defined by an axially projecting circular flange 169. Groove 168 preferably receives a torsion coil spring 170. One end 172 of the spring 170 is held in a generally fixed position by a portion 174 of pivot support member 166 defining part of the annular groove 168. As is indicated in FIG. 15, the remaining end 176 of spring 170 rotates with a pair of transverse projections 178 and 179 of the lever arm 20, from an initial position when the lever arm 20 is down (indicated in solid) to a second position when the lever arm 20 is raised (indicated in phantom). A viscous material 171 (indicated by speckling), such as petroleum jelly or a substantially non-drying, silicone based grease, is preferably provided between interfitted circular flange and groove areas of the one end of the bearing member 50 and the facing side of the pivot support member 166, which retards and dampens the movement of lever arm 20. Preferably, support member 166 and the facing end of bearing member 50 together with the viscous material define a viscous clutch.

Torsion coil spring 170 is compressed when the lever arm 20 is latched in its initial, lowered position shown in FIGS. 1, 3 and 4. When latch member end 26*a* is withdrawn from opening 56 and the free end of arm 20 released, the second end 176 of spring 170 rotates away from the one end 172 to the position shown in phantom in FIG. 15, thereby pivoting the arm 20 to a generally upright position shown in FIG. 2.

While the arm 20 is rising, the viscous clutch formed between the pivot support member 166 and the facing end of the bearing member 50 acts as is a motion retarder, which slows the elevation of arm 20.

Figure 16:
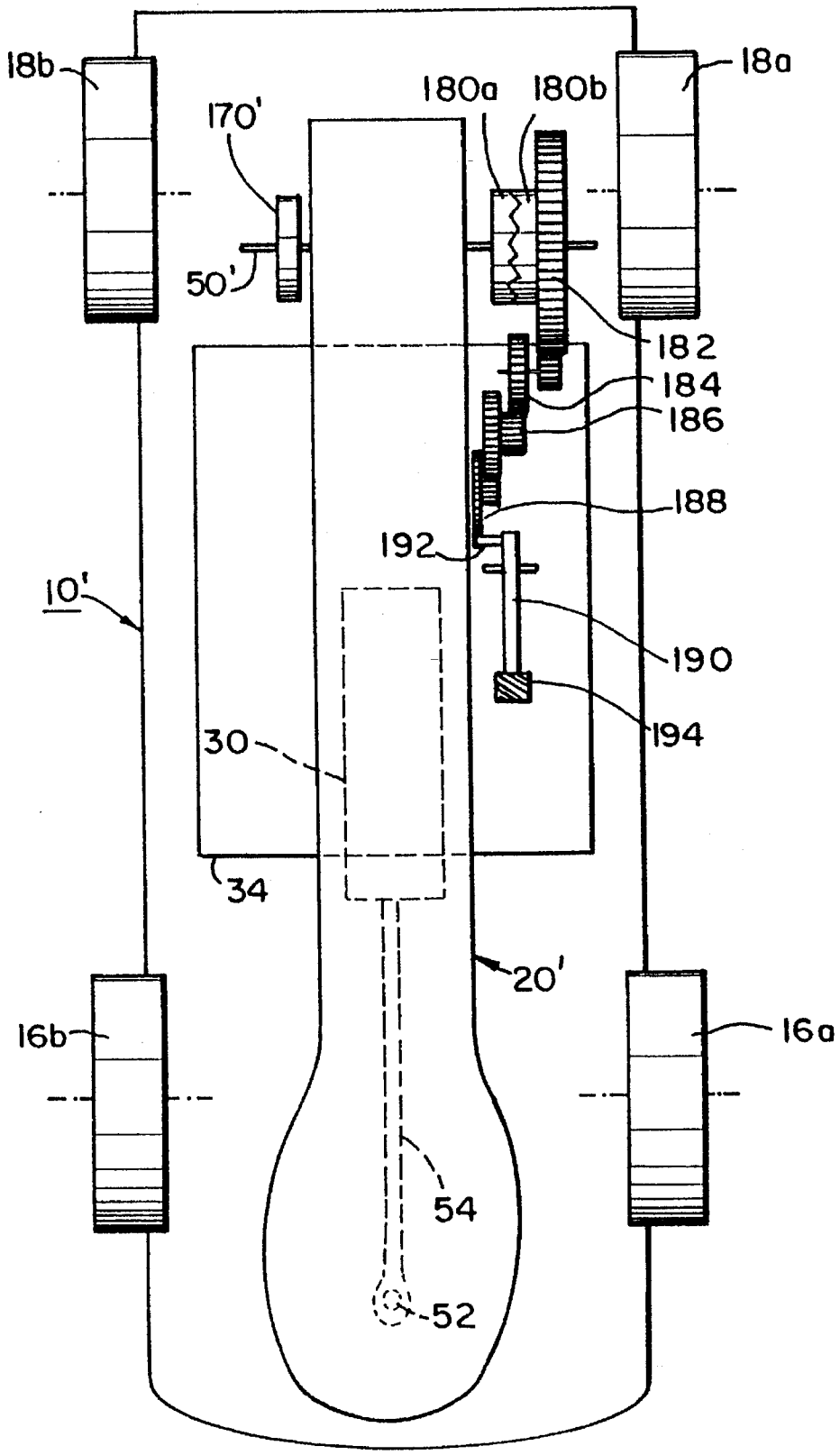
FIG. 16 is a view of an alternate arm movement retarding mechanism in the form of an escapement.

FIG. 16 depicts diagrammatically one alternate configuration for moving, preferably elevating, and retarding the movement (elevation) of an arm 20'. Arm 20' pivots on a shaft 50' and is raised by means of a coil spring 170' wound around and having one end fixed to the shaft 50' and an opposing end fixed with the vehicle 10'. An opposing side of the shaft 50' supports a spring loaded clutch having halves 180*a* and 180*b*. Half 180*a* is fixed to the shaft 50'. Half 180*b* is fixedly coupled with a main gear 182 driving succeedingly higher gears 184 and 186 which, in turn drive an escapement wheel 188. A lever 190 has a fork 192, the ends of which alternately engage the escapement wheel 188. An escapement weight 194 is provided at an opposing end of the lever. The weight and location of the weight control the speed of the escapement mechanism and thus the speed of the arm 20' as it rises. The movement of arm 20 or 20' or any other nozzle carrying structure can be retarded and slowed in any of a variety of ways using any of a variety of devices, which can be engaged or coupled with the moving structure to impose a resistive load on a moving structure including, for example and without limitation, anything which would dampen movement of the arm or other moveable structure.

While the moveable structure of the vehicle 10 carrying the nozzle is preferably an elevating arm 20, 20', it will be appreciated that numerous other arrangements are possible. For example, an elevating structure could rise directly from the remainder of the vehicle on a column or as a column or even as part of a telescoping structure. While one pivoting arm has been disclosed, two or more pivotally mounted arms can be linked to pivot in parallel to raise a nozzle carrying platform or nozzle structure on a carriage. While a torsion spring is preferred for elevating the arm, it will be appreciated that arms and other structures can be elevated by other means including a variety of springs and other rotatably or linearly acting biasing members, operating directly or through rigid and/or flexible member linkages. While a mechanical spring is preferred to supply the power to elevate the arm, other power sources, especially any of a variety of displacement electro-mechanical actuators as well as electromagnetic actuators and fluidic (hydraulic/pneumatic) actuators could be provided, acting directly on such structures or through linkages or other force transmitting members and/or devices.

While an elevating arm is preferred as the movable structure for transforming the appearance of the vehicle and revealing and elevating the nozzle, the movable structure might be movable in other directions and/or in other ways. For example and without limitation, the structure might extend, pivot, telescope, expand, unfold or otherwise move outwardly to or rotate on the front, rear and/or either or both sides of the vehicle. It is further recognized that the structure might be movable by a reversible actuator so that the structure can be driven back and forth between the first and second positions. However, another control channel, band, code, etc. would have to be provided for independent remote control of water, squirting and transforming functions.

While it is preferred that the nozzle be initially hidden in the first position of the movable structure and exposed to eject a water stream and only after transformation of the vehicle, it is recognized that the nozzle can be fixed on the remainder of the vehicle where it is always exposed to eject and may even be positioned on either the movable member or the remainder of the vehicles so as to be exposed only in the first position of the movable structure so that it operates only before transformation.

While wireless signal control is preferred, a remote control unit can be hard wired to a vehicle 10. Control signals can be passed from the remote control unit through the wire(s) for processing in the vehicle or electric drive signals can be supplied directly from the remote control unit to drive circuits located in the vehicle. In addition, the reservoir water supply, pump or both can be located in the remote control unit and coupled to the vehicle through a fluid coupling.

While radio wireless control is preferred, other wireless control including but not limited to infrared and ultrasonic signals can be used. Power may be supplied to an electrically powered actuator of the vehicle directly by the signal processed or after boosting by an amplifier or a control signal may be generated by the vehicle processor in response to transmitted control signals received in the vehicle to control relays or other switches providing more powerful electric currents to the various motors and/or actuators.

While remotely controlled toy vehicles are preferred, it is recognized that less expensive toy vehicle having some of the novel entertainment features of the invention, notably the water squirting capability with transformation capability, will undoubtedly follow in the success of the preferred embodiment vehicle and similar remotely controlled vehicles. Such vehicles are typically automatically operating and would be, for example, automatically running and automatically squirting immediately or after a predetermined period of operation or distance of movement. Such vehicles are typically fully electrically or fully mechanically powered or partially electrically and partially mechanically powered. All are intended to be encompassed as part of the present invention.

While a reciprocating piston is preferred as the fluid drive member for pumping liquid, the electrically actuated pump fluidly coupled to nozzle 52 may include a chamber with a rotating turbine fluid drive member or a wall formed at least partially by piezoelectric crystal fluid drive member or a wall formed at least in part by a flexible diaphragm with a piezoelectric crystal, a electromagnet or any other member or assembly which oscillates or reciprocates the diaphragm. Alternatively, a flexible chamber such as a flexible tube might be provided, which can be compressed against a stop surface by one movable member or compressed by a pair of opposing members such as one or more rollers.

While road contacting, vehicle supporting wheels are preferred for the propulsion members of the vehicle embodiment 10, other ground contacting vehicle propulsion members might be used including, but not limited to, ground contacting tracks with non-ground contacting, vehicle supporting drive wheels like those disclosed in U.S. Pat. No. 5,135,427 or non-ground contacting, non-vehicle supporting sprockets like that disclosed in U.S. Pat. No. 3,521,527, or ground contacting, vehicle supporting screws like those disclosed in U.S. Pat. Nos. 3,906,888 or 4,476,948, all of which are incorporated by reference herein.

The preferred embodiment of the present invention provides in addition to a basic, remotely controlled, water squirting toy feature on a vehicle, the added feature of transformation and appearance change, which, while generally well known in the toy art, has not heretofore been combined in remotely controlled vehicles with an added water squirting capability directly to the transformed appearance of the vehicle.

While the head and upper body of the snake are presently preferred, other creatures or creature appendages or body parts of the same might be used. For example and without limitation, the moving element may hide the face of a dragon or dolphin or the stinger of a scorpion or an insect or the face or another part of a mythological or totally imaginary creature.

If desired, the electrically actuated pump 30 may be temporarily disabled while the arm 20 or other provided structure is moving. This may be done in a variety of ways. One way is to provide a pair of momentary contact switches coupled in parallel in the pump drive circuit 158, one switch being closed only when the arm is latched into its first position as shown in FIGS. 1, 3 and 4 and the other being closed only when the arm has moved to its second position as shown in FIG. 2.

It will be seen that toy vehicles of the present invention provide significant amusement both from the surprising physical transformation the toy can undergo from a conventional vehicle to an at least initially threatening creature and then a surprising water squirting capability which enables the toy operator to squirt things from afar and to even chase them under remote control while squirting them. The surprise element of the toy is heightened by hiding the nozzle on the vehicle, preferably initially within the vehicle and later within the creature appearing portion of the vehicle itself, so that the source of the squirted water may not be readily apparent.

While a preferred embodiment of the invention has been disclosed and numerous modifications thereto suggested, still other modifications will occur to those of ordinary skill in the art. Accordingly, the present invention is not limited to the preferred and other embodiments disclosed but is rather set forth in the accompanying claims.

We claim:

1. A transforming, water squirting toy vehicle comprising:

a ground contacting vehicle propulsion member;

a propulsion unit drivingly coupled with the vehicle propulsion member;

a structure mounted to a remainder of the vehicle for movement from a first position to a second position, a surface of the structure being hidden within the reminder of vehicle in the first position and exposed to view in the second position, the surface having an appearance of at least part of a creature;

a nozzle located on the structure so as to be hidden within the reminder of vehicle in the first position of the structure and exposed to view in the second position of the structure; and a pump fluidly coupled with the nozzle.

2. The vehicle of claim 1 further comprising;

a first electric drive circuit coupled with the propulsion unit and responsive to a first propulsion control signal;

an electrically operated actuator coupled with the pump; and a second electric drive circuit coupled with the electrically operated actuator and responsive to a second water squirt control signal.

3. The vehicle of claim 1 wherein the structure is a lever arm having one end pivotally mounted to the remainder of the vehicle proximal a rear end of the vehicle and an opposing free end extending to proximal a front end of the vehicle in the first position and elevated generally above the remainder of the vehicle in the second position.

4. The vehicle of claim 3 wherein the hidden surface of the arm bears the appearance of a face and at least part of a body of a snake and wherein the nozzle is located proximal the free end of the arm and the face of the snake.

5. The vehicle of claim 1 wherein the pump comprises a chamber and a fluid drive member movably positioned in the chamber and further comprising an electrically powered actuator mechanically coupled with the fluid drive member so as to move the fluid drive member in the chamber to move liquid through the chamber.

6. The vehicle of claim 5 further comprising a latch member coupled with the electrically powered actuator for movement when the electrically powered actuator is operated between a first latch position engaged with the structure and a second latch position disengaged from the structure.

7. The vehicle of claim 1 further comprising a liquid reservoir removably and fluidly coupled with the pump.

8. The vehicle of claim 2 further comprising a battery power supply and a radio receiver coupled with the battery power supply, the battery power supply further being selectively coupled with the propulsion unit through the first drive circuit and with an electrically operated actuator coupled with the pump through the second drive circuit.

9. The vehicle of claim 8 further comprising a latch member movable between a first latch position engaged with the structure in the first position of the structure and a second latch position disengaged from the structure in the first position of the structure, the latch member being coupled with the electrically operated actuator for movement of the latch from the first latch position to the second latch position upon operation of the electrically powered actuator.

10. The vehicle of claim 9 wherein the pump includes a movable fluid drive member coupled with the electrically operated actuator.

11. The vehicle of claim 10 wherein the pump further includes a chamber receiving the movable fluid drive member.

12. The vehicle of claim 1 further comprising a bias member positioned between the structure and the remainder of the vehicle so as to move the structure from the first position to the second position and a movement retarder applying a load to the structure so as to slow movement of the structure from the first position to the second position.

13. The vehicle of claim 12 wherein the movement retarder comprises a viscous clutch.

14. The vehicle of claim 12 wherein the movement retarder comprises an escapement.

15. A remotely controlled, water squirting toy vehicle responsive to propulsion and water squirting control signals from a remote control unit separate from the vehicle, the vehicle comprising:

a housing;

a ground contacting vehicle propulsion member supporting the housing for movement along the ground;

an electric motor or actuated propulsion unit drivingly coupled with the propulsion member;

a liquid reservoir;

a nozzle mounted to the vehicle so as to project a liquid stream in at least one configuration of the vehicle;

an electrically actuated pump fluidly coupling the reservoir with the nozzle;

a structure mounted to the vehicle for movement with respect to the housing between a first position and a second position, the structure cooperating with the housing in the first position to define a vehicle body exterior sufficiently continuous to cover and conceal the nozzle from view and the structure being moved sufficiently with respect to the housing in the second position to uncover and expose the nozzle and permit the nozzle to project the liquid stream from the vehicle;

a first drive circuit responsive to a vehicle propulsion control signal to selectively supply electric power to the propulsion unit; and a second drive circuit responsive to a water squirt control signal to selectively supply electric power to the electrically actuated pump, the second drive circuit supplying power independently from power supplied by the first drive circuit.

16. The vehicle of claim 15 wherein the structure includes a surface hidden within the vehicle in the first position and exposed to view in the second, elevated position, the surface bearing an appearance of at least part of a creature.

17. The vehicle of claim 16 further comprising a radio receiver, a signal processor coupled between the receiver and the first and second drive circuits, and a battery power supply coupled at least indirectly through the first drive circuit with the electric motor actuated propulsion unit and at least indirectly through the second drive circuit with the electrically actuated pump.

18. The vehicle of claim 17 wherein the structure is an arm pivotably mounted to a remainder of the vehicle to pivot from a generally horizontal first position to a generally vertical second position.

19. A transforming, water squirting toy vehicle comprising:

a ground contacting vehicle propulsion member;

an drive unit drivingly coupled with the vehicle propulsion member;

a structure mounted to a remainder of the vehicle for movement from a first position to a second position, a surface of the structure being hidden within the vehicle in the first position and exposed to view in the second position, the surface having an appearance of at least part of a creature;

a nozzle located on the vehicle so as to be hidden within the vehicle in the first position of the structure and exposed to view in the second position of the structure; and a pump fluidly coupled with the nozzle.

* * * * *